US005603611A

United States Patent [19]

Tarutani et al.

[11] Patent Number: 5,603,611

[45] Date of Patent: Feb. 18, 1997

[54] PISTON TYPE COMPRESSOR WITH SIMPLE BUT VIBRATION-REDUCING SUCTION REED VALVE MECHANISM

[75] Inventors: Tomoji Tarutani; Noriyuki Shintoku, both of Kariya, Japan

[73] Assignee: Kabushiki Kaisha Toyoda Jidoshokki Seisakusho, Aichi-ken, Japan

[21] Appl. No.: 617,291

[22] Filed: Mar. 18, 1996

[30] Foreign Application Priority Data

Mar. 22, 1995 [JP] Japan ..... 7-062934

[51] Int. Cl.[6] ..... F04B 1/12

[52] U.S. Cl. ..... 417/269; 417/569; 417/571; 137/856

[58] Field of Search ..... 417/269, 569, 417/571; 137/856

[56] References Cited

U.S. PATENT DOCUMENTS

| | | | |
|---|---|---|---|
| 3,998,571 | 12/1976 | Falke | 417/569 |
| 4,193,424 | 3/1980 | Hrabal | 417/571 X |
| 4,749,340 | 6/1988 | Ikeda et al. . | |
| 4,836,754 | 6/1989 | Ikeda et al. | 417/269 |
| 5,147,190 | 9/1992 | Hovarter | 417/571 |
| 5,342,178 | 8/1994 | Kimura | 417/269 |

*Primary Examiner*—Richard E. Gluck
*Attorney, Agent, or Firm*—Burgess, Ryan and Wayne

[57] ABSTRACT

A piston type compressor provided with a suction valve mechanism which includes a suction valve element having suction reed valves openably closing suction ports for providing a fluid communication between a suction chamber for refrigerant gas before compression and cylinder bores in which pistons reciprocate to compress the refrigerant gas. The cylinder bores are provided with a first axially recessed engaging face engaging with frontmost end portions of the suction reed valves to provide the suction reed valve with a preliminary step of stopping condition, and a second axially recessed engaging face portions engaged with an inner portion of the suction reed valves to provide the suction reed valve with a final step of stopping condition. The preliminary step of stopping condition of the suction reed valves ensures suppression of uncontrolled self-vibration of the suction reed valves, and the final step of stopping condition of the suction reed valves ensures a stable and optimum amount of opening of the suction reed valves.

4 Claims, 3 Drawing Sheets

PISTON TYPE COMPRESSOR WITH SIMPLE BUT VIBRATION-REDUCING SUCTION REED VALVE MECHANISM

BACKGROUND OF THE INVENTION

1. Field of The Invention

The present invention relates to a piston type compressor with a vibration-reducing suction valve mechanism, adapted for use as a refrigerant compressing unit to be incorporated in a refrigerating system or a climate control system. The refrigerating or climate control system may be used in an automobile.

2. Description of the Invention

Generally, a piston type compressor, such as a swash plate type compressor or a wobble plate type compressor, is provided with a cylinder block having therein a plurality of cylinder bores defined as compression chambers in which a plurality of pistons are reciprocated to compress a refrigerant gas. The piston type compressor further includes a valve plate or plates in which suction and discharge ports are bored to be in registration with the respective cylinder bores, suction and discharge reed valves arranged in contact with the surfaces of the valve plate to openably close the suction and discharge ports, and a housing or housings to close the axial end or ends of the cylinder block via the valve plate. The housing is arranged so as to define therein a suction chamber for a refrigerant gas before compression and a discharge chamber for the refrigerant gas after compression. The suction and discharge reed valves are brought into a close contact with the faces of the valve plate or valve plates when the respective valves close the suction and discharge ports, and are separated from the faces of the valve plate or plates when the respective valves open the suction and discharge ports. Further, the cylinder block is provided with stops arranged at end portions of the respective cylinder bores so that the free ends of the suction reed valves are engaged with and stopped by the stops when the respective suction reed valves move from the position closing the suction ports to the position opening the suction ports of the valve plate or plates. Namely, the amount of opening of the respective suction reed valves is restricted by the stops of the cylinder blocks, and the stops are usually formed in recesses provided by cutting a part of the end portion of a cylindrical wall enclosing each cylinder bore. Thus, the opening amount of each suction reed valve is determined by a depth of each recess formed in the cylindrical wall of each cylinder bore. Nevertheless, when the compressor operates at either an idling speed or a low rotating speed, and at a small delivery capacity, the flow of refrigerant gas throughout the refrigerating system including the compressor is sharply reduced. Thus, the amount of refrigerant gas from the suction chamber into the respective cylinder bores is very small, and accordingly, the free end portion of each suction reed valve cannot be sufficiently bent until the free end portion of the suction reed valve is certainly engaged with the recessed stop of the cylinder block. Consequently, the suction reed valves cause uncontrolled self-vibrating motions which generate noise.

On the other hand, when the depth of the respective recessed stops is set small, although the self-vibrating problem of the suction reed valves can be overcome, the amount of opening of the suction reed valves is necessarily made small. Accordingly, suction performance of the suction valve mechanism of the piston type compressor must be reduced.

SUMMARY OF THE INVENTION

Therefore, a primary object of the present invention is to prevent not only a reduction in the suction performance of the suction reed valves of the suction valve mechanism of a piston type compressor but also an occurrence of self-vibration of the suction reed valves of the compressor.

Another object of the present invention is to provide a piston type compressor provided with a suction valve mechanism having a simple stop unit for stopping the suction reed valves at an optimum opening position thereof without causing self-vibration and noise of the suction reed valves over an entire range of a rotating speed of the compressor and a reduction in the suction performance of the suction valve mechanism.

In accordance with the present invention, there is provided a piston type refrigerant compressor which comprises a cylinder block provided with a plurality of cylinder bores circumferentially arranged around a central axis thereof, the cylinder bores receiving a plurality of reciprocating pistons.

At least one valve plate is arranged adjacent to an axial end of the cylinder block, and is provided with a plurality of pairs of suction and discharge ports bored therethrough at positions in registration with the respective cylinder bores.

A suction valve element is arranged adjacent to one face of the valve plate, and includes a plurality of suction reed valves for openably closing the suction ports of the valve plate.

A discharge valve element is arranged adjacent to the other face of the valve plate and arranged for openably closing the discharge ports of the valve plate.

At least one housing is arranged for closing the axial end of the cylinder block via the valve plate, and defining therein a suction chamber for refrigerant gas before compression and a discharge chamber for the refrigerant gas after compression.

A suction valve stop means is arranged at end portions of the respective cylinder bores to be engaged by free ends of the respective suction reed valves during continuous operation of the suction valve element.

An arrangement wherein the suction valve stop means comprises a first predetermined engaging face having a first predetermined depth with respect to the axial end of the cylinder block and being engaged by a frontmost portion of the free end of each suction reed valve to thereby provide each suction reed valve with a preliminary step of stopping motion.

A second predetermined engaging face having a second predetermined depth larger than the first predetermined engaging face with respect to the axial end of the cylinder block is also provided, the second predetermined engaging face being engaged with the free end of each suction reed valve at a portion contiguous to the frontmost portion thereof to thereby provide each suction reed valve with a final step of stopping motion.

Preferably, the first and second predetermined engaging faces of the suction valve stopping means comprise a first and second partial counter-bores formed in the end portions of the respective cylinder bores, the first and second partial counter-bores being enclosed by a first and second partial cylindrical walls, respectively.

Preferably, the first and second partial cylindrical walls of the suction valve stopping means extend to have an equal radius of curvature.

In the suction valve stopping means according to the present invention, when the suction reed valves of the suction valve mechanism move from the closing positions thereof closing the associated suction ports to the opening positions thereof in response to a suction stroke of the respective pistons, the frontmost portion of the free end of each suction reed valve bends and comes into engagement with the first predetermined engaging face of the suction valve stop means to be subjected to the first preliminary stopping motion whereby the suction reed valves are prevented from causing uncontrolled self-vibration. Subsequently, each suction reed valve further bends until the portion contiguous to the frontmost portion thereof comes into engagement with the second predetermined engaging face to be subjected to the final step of stopping motion. Thus, the opening motion of each suction reed valve of the suction valve mechanism is completed so as to permit the associated cylinder bore to suck the refrigerant gas before compression from the suction chamber.

It should be understood that since the first predetermined engaging face of the suction valve stopping mechanism is arranged so as to provide the frontmost portion of each of the suction reed valves with the above-mentioned preliminary stopping motion irrespective of operating condition of the piston type refrigerant compressor, the suction valve mechanism of the compressor can be prevented from causing the uncontrolled self-vibration of the suction reed valves during all operating conditions of the compressor.

BRIEF DESCRIPTION OF THE DRAWINGS

The above and other objects, features and advantages of the present invention will be made apparent from the ensuing description of the preferred embodiment thereof, with reference to the accompanying drawings wherein.

DESCRIPTION OF THE PREFERRED EMBODIMENT

Figure 1:
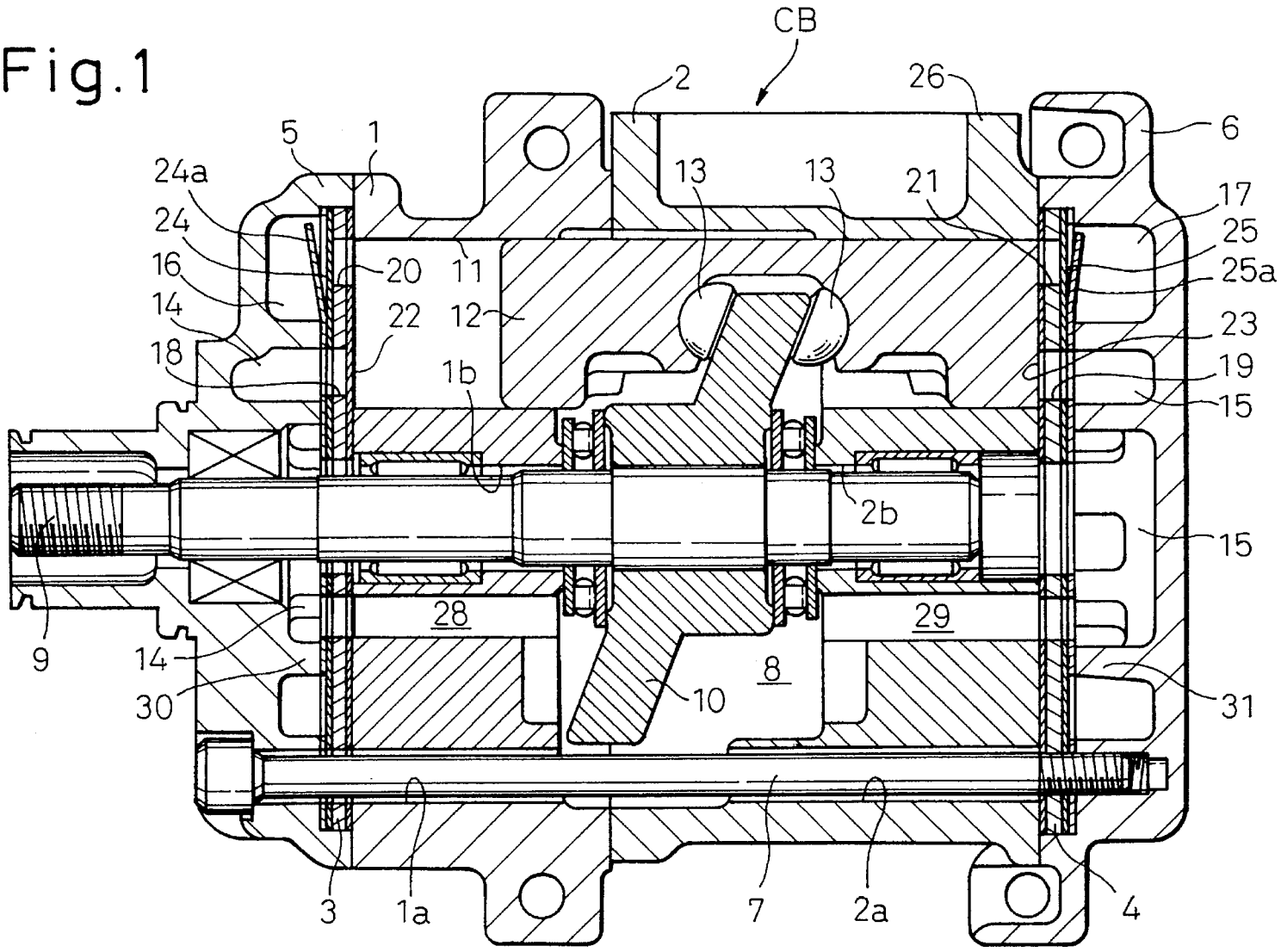
FIG. 1 is a longitudinal cross-sectional view of a piston type refrigerant compressor according to a preferred embodiment of the present invention.

Referring to FIG. 1, a piston type compressor is provided with a cylinder block CB including a front cylinder block 1 having a plurality of (five) cylinder bores 11, and a rear cylinder block 2 having a plurality of (five) cylinder bores 11 coaxial with the cylinder bores 11 of the front cylinder block 1. The cylinder block CB has axial ends closed by a front housing 5 via a front valve plate 3, and by a rear housing 6 via a rear valve plate 4. The front housing 5, the front valve plate 3, the front cylinder block 1, the rear cylinder block 2, the rear valve plate 4, the rear housing 6 are tightly secured together by a plurality of long screw bolts 7 which are inserted in axial screw bores 1*a* and 2*a*. The cylinder block CB including the front and rear cylinder blocks 1 and 2 is provided with a swash plate chamber 8 arranged in a connecting portion of the front and rear cylinder blocks 1 and 2. The swash plate chamber 8 receives therein a swash plate 10 fixedly mounted on a drive shaft 9 arranged so as to extend in coaxial central bores 1*b* and 2*b*. The front and rear cylinder blocks 1 and 2 have five cylinder bores 11, respectively, extending axially coaxially. The cylinder bores 11 are circumferentially arranged around the central axis of the cylinder block CB, and slidably receive therein double-headed pistons 12 which are operatively engaged with the swash plate 10 via semi-spherical shoes 13.

The front and rear housings 5 and 6 are internally provided with front and rear suction chambers 14 and 15, and front and rear discharge chambers 16 and 17. The front suction and discharge chambers 14 and 16, and the rear suction and discharge chambers 15 and 17 are fluidly isolated by front and rear partition walls 30 and 31, respectively. The front and rear valve plates 3 and 4 are provided with a plurality of suction ports 18 and 19 formed therein, respectively, for introducing refrigerant gas before compression (low pressure gas) from the front and rear suction chambers 14 and 15 into the respective cylinder bores 11 in response to the suction stroke of the double-headed pistons 12. The front and rear valve plates 3 and 4 are also provided with a plurality of discharge ports 20 and 21 formed therein, respectively, for discharging the refrigerant gas after compression (high pressure gas) from the respective cylinder bores 11 into the front and rear discharge chambers 16 and 17.

The front and rear valve plates 3 and 4 are further provided with front and rear suction valve elements 22 and 23 attached to inner faces thereof, i.e., the faces confronting the axial ends of the front and rear cylinder blocks 1 and 2. The front and rear valve plates 3 and 4 are also provided with front and rear discharge valve elements 24 and 25 attached to outer faces thereof, i.e., the faces confronting the front and rear housings 5 and 6, via front and rear valve retainers 24*a* and 25*a*.

The rear cylinder block 2 is provided with a mount 26 at an upper portion thereof so as to be capable of being connected to a non-illustrated flange member by which the compressor is connected to an external refrigerating system. The mount 26 is provided with an inlet port (not shown in FIG. 1) having an end opening into the swash plate chamber 8, so that the refrigerant gas before compression is introduced from the external refrigerating system into the swash plate chamber 8 via the inlet port. The front and rear cylinder blocks 1 and 2 are also provided with a plurality of inlet passageways 28 and 29 formed in a central portion thereof adjacent to the central bores 1*b* and 2*b*, and located between two respective cylinder bores 11. The inlet passageways 28 and 29 are provided for permitting the refrigerant gas to flow from the swash plate chamber 8 into the respective suction chambers 14 and 15.

The above-mentioned mount 26 is further provided with an outlet port (not shown) which is fluidly communicated with discharge passageways (not shown) formed in the front and rear cylinder blocks 1 and 2 and located between two respective cylinder bores 11. The discharge passageways communicate with the front and rear discharge chambers 16 and 17, so that the refrigerant gas after compression is delivered from the discharge chambers 16 and 17 toward the external refrigerating system via the discharge passageways and the above-mentioned outlet port.

A description of a suction valve mechanism incorporated in the above-described compressor will be provided below.

The suction valve mechanism is provided with the above-mentioned front and rear suction valve elements 22, 23, the front and rear suction ports 18, 19, and a later-described suction reed valve stopping means arranged on each of the front and rear sides of the compressor to control the opening motion of later-described suction reed valves of the front and rear suction valve elements 22 and 23. At this stage, since the suction reed valve stopping means on the front side is similar to that on the rear side, the description of the suction reed valve stopping means arranged on the rear side of the compressor is typically provided below with reference to FIGS. 2 through 5.

Figure 2:
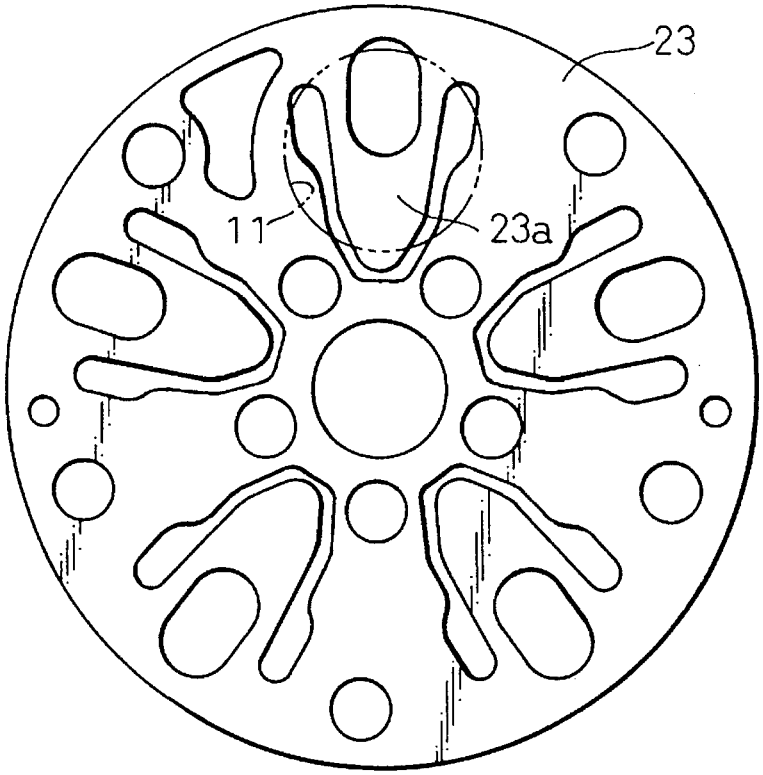
FIG. 2 is a front view of a suction valve element having a plurality of suction reed valves.

Referring to FIG. 2, the rear suction valve element 23 is formed as a single disk-like element provided with a plurality of (five) suction reed valves 23*a* arranged so as to confront the corresponding number of (five) cylinder bores 11 of the rear cylinder block 2 (see FIG. 1). The suction reed valves 23*a* are formed as independent flexible reeds arranged so as to be radially inwardly directed from the circumference of the disk-shape rear suction valve element 23 to the center of the same element 23. Each of the reed valves 23*a* has a free front end and a base portion adjacent to the circumference of the valve element 23.

Figure 3:
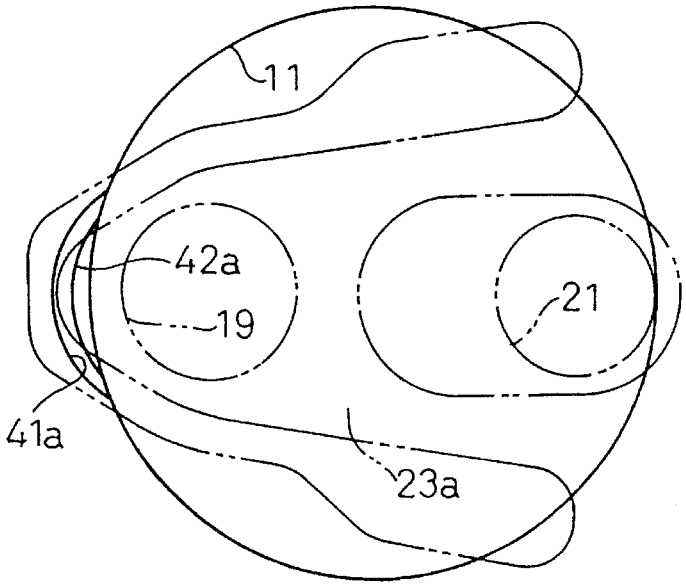
FIG. 3 is an enlarged explanatory view of one of a plurality of cylinder bores and an associated suction reed valve, illustrating a positional and operational relationship therebetween.
Figure 4:
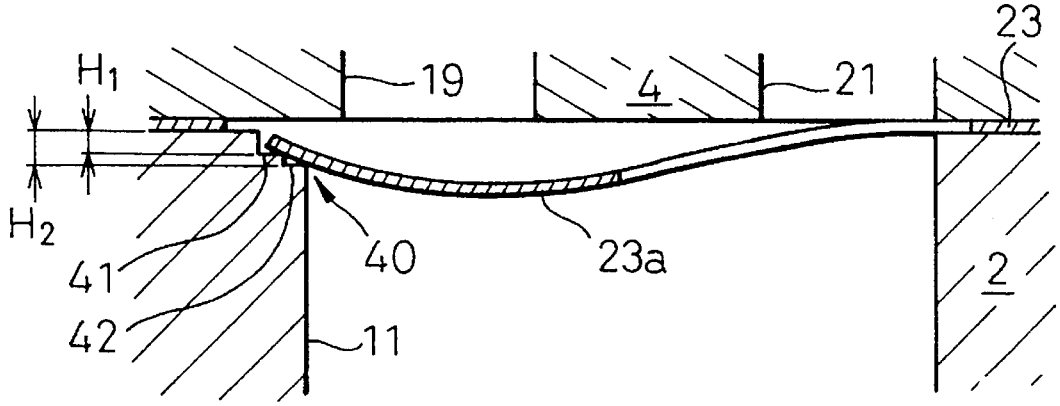
FIG. 4 is a schematic cross-sectional view of an end portion of one of the cylinder bores and a part of a valve plate, illustrating a final opening motion of one of the suction reed valves of the suction valve element of FIG. 2; and, FIG. 5 is a similar schematic cross-sectional view of an end portion of one of the cylinder bores and a part of a valve plate, illustrating a preliminary opening motion of one of the suction reed valves of the suction valve element of FIG. 2.
Figure 5:
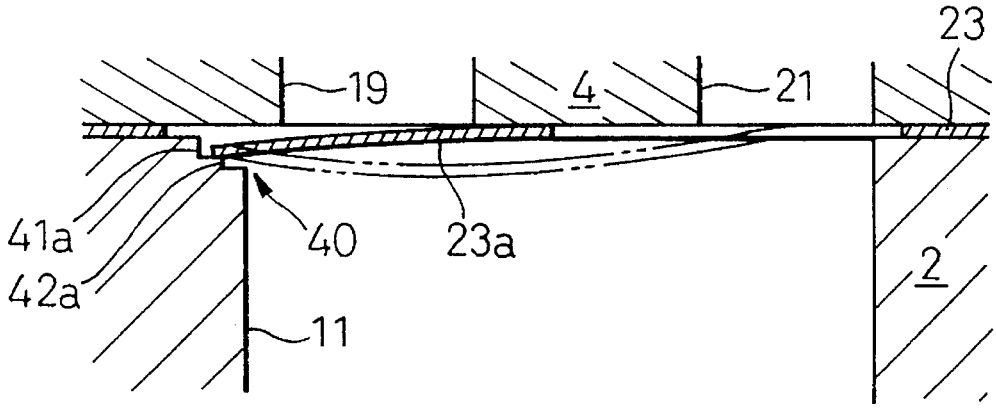

As shown in FIGS. 3 through 5, each reed valve 23*a* extends diametrically with respect to the related cylinder bore 11, and the above-mentioned free front end of the reed valve 23*a* extends beyond the circular edge of the cylinder bore 11 (see FIG. 3).

The cylinder bore 11 is provided with a valve engaging portion 40 which acts as a valve stop for limiting an opening of the suction reed valve 23*a*. The valve engaging portion 40 consists of a recess formed by cutting a part of the inner wall of the cylindrical bore 11 at a position corresponding to the axial end of the cylinder bore 11 and in registration with the free end portion of the suction reed valve 23*a*.

The valve engaging portion 40 includes a first engaging face portion 41 formed so as to be engaged by the frontmost end portion of the flexible suction reed valve 23*a* during the initial stage of the opening motion of the suction reed valve 23*a*, and a second engaging face portion 42 formed so as to be engaged by a radially inner portion of the suction reed valve 23*a*, which portion is contiguous with the frontmost end portion thereof, during the final stage of the opening motion of the suction reed valve 23*a*. Namely, the first engaging face portion 41 of the engaging portion 40 can provide the suction reed valve 23*a* with a preliminary step of stopping upon being engaged by the frontmost end portion of the suction reed valve 23*a*, and the second engaging face portion 42 of the valve engaging portion 40 formed so as to have an axial depth from the axial end of the cylinder bore 11 which is deeper than that of the first engaging face portion 41 can provide the suction reed valve 23*a* with a final step of stopping upon being engaged by the above-mentioned radially inner portion of the suction reed valve. When the suction reed valve 23*a* is finally stopped by the engagement of the radially inner portion thereof with the second engaging face portion 42 of the engaging portion 40, the opening motion of the suction reed valve 23*a* due to flexing thereof is compulsorily stopped.

It should be noted that the first and second engaging face portions 41 and 42 of the valve engaging portion 40 are formed as counter-bores having partial circular walls 41*a* and 42*a*, respectively, as best shown in FIG. 3.

As clearly shown in FIG. 4, the first engaging face portion 41 of the valve engaging portion 40 has an axial depth "$H_1$" measured at an edge of the cylinder bore 11 from the axial end thereof, and the depth $H_1$ is predetermined so that when the suction reed valve 23*a* of the rear suction valve element 23 is opened and flexed by a suction pressure acting from the cylinder bore 11, the frontmost end portion of the suction reed valve 23*a* is engaged with and stopped by the first engaging face portion 41, without fail, irrespective of any change in the operating condition of the compressor. Namely, as shown in FIG. 5, the suction reed valves 23*a* of the rear suction valve element 23 are always given the preliminary step of stopping due to the engagement of the frontmost end portion thereof with the first engaging face portion 41.

The second engaging end face portion 42 of the valve engaging portion 40 of the cylinder bore 11 has an axial depth "$H_2$" measured at an edge of the cylinder bore 11 from the axial end of the cylinder bore 11.

As shown in FIG. 4, the depth "$H_2$" is deeper than the depth "$H_1$", and is predetermined so that when the suction reed valve 23*a* of the rear suction valve element 23 is further opened and flexed after the engagement of the frontmost end portion thereof with the first engaging face portion 41, the radially inner portion contiguous with the frontmost end portion of the suction reed valve 23*a* can be engaged with and stopped by the second engaging face portion 42 of the valve engaging portion 40 of the cylinder bore 11, and thus an optimum amount of opening of the suction reed valve 23*a* is stably obtained so as to permit the refrigerant gas to flow into the cylinder bore 11 from the rear suction chamber 15 via the rear suction port 19. The first and second engaging face portions 41 and 42 are not shown in FIG. 1, in view of the limited space in FIG. 1.

It should be understood that the front suction valve mechanism arranged on the front side of the compressor has a similar construction and a similar operation to the above-mentioned rear suction valve mechanism arranged on the rear side of the compressor.

In the piston type compressor provided with the above-described suction valve mechanism on each of the front and rear sides of the compressor, when the drive shaft 9 is rotated together with the swash plate 10, the respective double-headed pistons 12 are reciprocated in the respective cylinder bores 11 so as to perform suction of the refrigerant gas, compression of the refrigerant gas, and discharge of the compressed refrigerant gas in cooperation with the cylinder bores 11 of the cylinder block CB. When the refrigerant gas before compression is introduced into the swash plate chamber 8 from the external refrigerating system, via the inlet port of the mount 26, and when the refrigerant gas flows from the swash plate chamber 8 into e.g., the rear suction chamber 15 via the inlet passageway 29, the refrigerant gas is sucked into the respective cylinder bores 11 in response to the suction stroke of the respective pistons 12 via the suction ports 19 and the opened suction reed valves 23*a* of the rear suction valve element 23. Subsequently, the sucked refrigerant gas is gradually compressed by the respective pistons 12 during the compression stroke thereof within the cylinder bores 11, and the compressed refrigerant gas is discharged from the respective cylinder bores 11 into the rear discharge chamber 17 when the pressure of the refrigerant gas reaches a predetermined pressure value sufficient for opening the discharge valve element 25, via the rear discharge port 21.

During the suction stroke of the respective pistons 12 in the cylinder bores 11, when pressure in the respective cylinder bores 11 is reduced to a level lower than that of pressure prevailing in the rear suction chamber 15, the respective suction reed valves 23*a* of the rear suction valve element 23 start to flex and open the suction ports 19. At the initial flexing stage, the suction reed valves 23*a* engage, at the frontmost end portions thereof, with the first engaging face portions 41 of the respective cylinder bores 11 so as to be brought into a preliminary step of a stopping condition thereof by the engagement with the first engaging face portions 41, as shown by solid lines in FIG. 5. Thus, any uncontrolled self-vibrating motion of the respective suction reed valves 23*a* of the rear suction valve element 23 is suppressed. Subsequently, when the suction reed valves 23*a* are further flexed to have a deeply bent posture thereof as shown in FIG. 4, the radially inner portions of the suction reed valves 23*a* are engaged with edges of the respective second engaging face portions 42, and thus, the suction reed valves 23*a* of the rear suction valve element 23 are brought into the final step of a stopping condition where an optimum amount of opening area for permitting an introduction of the refrigerant gas before compression into the cylinder bores 11 via the suction ports 19 is stably established between the rear suction ports 19 and the respective cylinder bores 11.

When the compressor is running at a relatively small delivery capacity operation, the final step of a stopping condition of the suction reed valves 23*a* of the rear suction valve element 23 is reduced to a state shown by two dotted broken lines in FIG. 5. However, the frontmost portions of the respective suction reed valves 23*a* of the suction valve element 23 can be always engaged with and stopped by the first engaging face portions 41 so that occurrence of self-vibration of the suction reed valves 23*a* of the rear suction valve element 23 can be certainly prevented, and accordingly, noise is not generated.

In the described embodiment of the present invention, the first and second engaging face portions 41 and 42 of the valve engaging portions 40 of the suction reed valve stopping means are formed as counter-bores having partial circular walls 41*a* and 42*a* as shown in FIG. 3. Therefore, it will be understood that the portions 41 and 42 of the valve engaging portions 40 can be easily bored by using a conventional cutting tool, i.e., a conventional end mill. At this stage, if the side walls 41*a* and 42*a* of the first and second engaging face portions 41 and 42 are given an equal radius of curvature, the two portions 41 and 42 can be bored by the same end mill without changing a cutting tool. Thus, simple production of the valve engaging portions of the suction valve stopping means can be achieved.

From the foregoing description of the preferred embodiment of the present invention, it will be understood that the front and rear suction valve mechanisms incorporated in a piston type compressor are provided with suction valve stopping means for limiting the opening motion of the suction reed valves of the front and rear suction valve element in two steps, i.e., the preliminary step of a stopping condition in which the frontmost end portions of the respective suction reed valves can be constantly stopped so as to prevent occurrence of uncontrolled self-vibration of the suction reed valves, and the final step of a stopping condition in which an optimum mount of suction opening permitting the refrigerant gas before compression to be certainly introduced into the respective cylinder bores from the suction chambers via the suction ports of the valve plates can be stably established. Thus, the operation of the compressor can be quiet due to prevention of any noisy sound caused by the self-vibration of the suction valve elements.

Further, the valve engaging portions of the respective cylinder bores can be easily manufactured by using a conventional cutting tool. Thus, productivity of the front and rear suction valve mechanisms of the piston type compressor can be increased. Moreover, since the valve engaging portions of the suction valve stopping means are formed by the cylindrical counter-bores provided in the axial end of the cylinder block, it is possible to provide such valve engaging portions of the suction valve stopping means by effectively using small portions of the axial end or ends of the cylinder block around the respective cylinder bores. Namely, an existing portion of the interior of the compressor can advantageously used for constructing the suction valve mechanism of the piston type compressor without employment of any additional part or element.

It should be understood that many modifications and variations will occur to persons skilled in the art without departing from the spirit and scope of the invention claimed in the accompanying claims.

What we claim:

1. A piston type refrigerant compressor comprising:

a cylinder block provided with a plurality of cylinder bores circumferentially arranged around a central axis thereof, said cylinder bores receiving a plurality of reciprocating pistons;

at least one valve plate adjacent to an axial end of said cylinder block, and provided with a plurality of pairs of suction and discharge ports bored therethrough at positions in registration with said respective cylinder bores;

a suction valve element in contact with one face of said valve plate, and including a plurality of suction reed valves for openably closing said suction sports of said valve plate;

a discharge valve element in contact with said other face of said valve plate for openably closing said discharge ports of said valve plate;

at least one housing closing said axial end of said cylinder block via said valve plate, and defining therein a suction chamber for refrigerant gas before compression and a discharge chamber for said refrigerant gas after compression;

a suction valve stop means at end portions of said respective cylinder bores engaged by free ends of said respective suction reed valves during continuous operation of said suction valve element; and said suction valve stop means comprising:

a first predetermined engaging face having a first predetermined depth with respect to said axial end of said cylinder block and being engaged by a frontmost portion of said free end of each suction reed valve to thereby provide each said suction reed valve with a preliminary step of stopping motion; and, a second predetermined engaging face having a second predetermined depth larger than that of said first predetermined engaging face with respect to said axial end of said cylinder block, said second predetermined engaging face being engaged with said free end of each suction reed valve at a portion contiguous to said frontmost portion thereof to thereby provide said each suction reed valve with a final step of stopping motion.

2. A piston type compressor according to claim 1, wherein said first and second predetermined engaging faces of said suction valve stopping means comprise first and second partial counter-bored faces formed in said end portions of said respective cylinder bores, said first and second partial counter-bored faces being enclosed by a first and second partial cylindrical walls, respectively.

3. A piston type compressor according to claim 2, wherein said first and second partial cylindrical walls of the suction valve stopping means have an equal radius of curvature.

4. A piston type compressor comprising:

a cylinder block provided with front and rear axial ends and a plurality of cylinder bores circumferentially arranged around a central axis thereof, said cylinder bores receiving a plurality of reciprocating double-headed pistons;

a front valve plate adjacent to the front axial end of said cylinder block, and provided with a plurality of pairs of front suction and discharge ports bored therethrough at positions in registration with said respective cylinder bores;

a rear valve plate adjacent to the rear axial end of said cylinder block, and provided with a plurality of pairs of rear suction and discharge ports bored therethrough at positions in registration with said respective cylinder bores;

a front suction valve element in contact with said front valve plate, and including a plurality of front suction reed valves for openably closing said front suction ports of said front valve plate;

a rear suction valve element in contact with said rear valve plate, and including a plurality of rear suction reed valves for openably closing said rear suction ports of said rear valve plate;

a front discharge valve element in contact with said front valve plate for openably closing said discharge ports of said front valve plate;

a rear discharge valve element in contact with said rear valve plate for openably closing said discharge ports of said rear valve plate;

a front housing closing said front axial end of said cylinder block via said front valve plate, and defining therein a front suction chamber for refrigerant gas before compression and a front discharge chamber for said refrigerant gas after compression;

a rear housing closing said rear axial end of said cylinder block via said rear valve plate, and defining therein a rear suction chamber for refrigerant gas before compression and a rear discharge chamber for said refrigerant gas after compression;

a front suction valve stop means at end portions of said respective cylinder bores and in said front axial end of said cylinder block engaged by free ends of said respective front suction reed valves during continuous operation of said front suction valve element;

a rear suction valve stop means end portions of said respective cylinder bores and in said rear axial end of said cylinder block engaged by free ends of said respective rear suction reed valves during continuous operation of said rear suction valve element;

said front suction valve stop means comprising:

a first predetermined engaging face having a first predetermined depth with respect to said front axial end of said cylinder block and being engaged by a frontmost portion of said free end of each front suction reed valve to thereby provide each said front suction reed valve with a preliminary step of stopping condition; and, a second predetermined engaging face having a second predetermined depth larger than that of said first predetermined engaging face with respect to said front axial end of said cylinder block, said second predetermined engaging face being engaged with said free end of each said front suction reed valve at a portion contiguous to said frontmost portion thereof to thereby provide said each front suction reed valve with a final step of stopping condition; and said rear suction valve stop means comprising:

a first predetermined engaging face having a first predetermined depth with respect to said rear axial end of said cylinder block and being engaged by a frontmost portion of said free end of each rear suction reed valve to thereby provide each said rear suction reed valve with a preliminary step of stopping condition; and, a second predetermined engaging face having a second predetermined depth larger than that of said first predetermined engaging face with respect to said rear axial end of said cylinder block, said second predetermined engaging face being engaged with said free end of each said rear suction reed valve at a portion contiguous to said frontmost portion thereof to thereby provide each said rear suction reed valve with a final step of stopping condition.

* * * * *